United States Patent [19]

Jeruzal

[11] Patent Number: 4,838,417

[45] Date of Patent: Jun. 13, 1989

[54] STORAGE PACK COMPRISING AT LEAST TWO STACKED AND NESTED TRAYS EACH LOADED WITH A PLURALITY OF SEMI-CIRCULAR SPLIT RING BEARING HALVES

[75] Inventor: Thomas M. Jeruzal, Brighton, Mich.

[73] Assignee: Chrysler Motors Corporation, Highland Park, Mich.

[21] Appl. No.: 233,393

[22] Filed: Aug. 18, 1988

[51] Int. Cl.[4] ..... B65D 85/58

[52] U.S. Cl. ..... 206/318; 206/518; 220/23.6

[58] Field of Search ..... 206/318, 515, 518; 220/23.6, 23.8; 217/26.5

[56] References Cited

U.S. PATENT DOCUMENTS

| | | | |
|---|---|---|---|
| 3,138,247 | 6/1964 | Perry | 206/46 |
| 3,272,371 | 9/1966 | Weiner | 217/26.5 |
| 3,307,685 | 3/1967 | White | 206/46 |
| 3,337,037 | 8/1967 | Thill et al. | 206/46 |
| 3,342,321 | 9/1967 | Haffey | 206/46 |
| 3,502,241 | 3/1970 | Smith | 220/23.6 |
| 4,619,363 | 10/1986 | Wolfseder | 220/23.6 |

*Primary Examiner*—Carroll B. Dority, Jr.
*Attorney, Agent, or Firm*—Edward A. Craig

[57] ABSTRACT

A storage pack is provided comprising at least two stacked and nested trays each loaded with a plurality of semicircular split ring bearing halves. Each tray includes a plurality of elongated compartments each of which has a rib structure on the bottom wall thereof defining a herringbone-type arrangement. Bearing halves are loaded into each tray compartment on one edge thereof with the ribs separating adjacent bearing halves. The ribs are of less height than the width of the bearing halves so that when one loaded tray is stacked and nested on another, the bearing halves assume the vertical load without loading the ribs.

3 Claims, 2 Drawing Sheets

STORAGE PACK COMPRISING AT LEAST TWO STACKED AND NESTED TRAYS EACH LOADED WITH A PLURALITY OF SEMI-CIRCULAR SPLIT RING BEARING HALVES

BACKGROUND OF THE INVENTION

1. Field of the Invention:

The invention relates to a storage pack of trays loaded with semi-circular split ring bearing halves.

2. Prior Art:

There has long been a problem associated with packaging of semi-circular split ring bearing halves. Split ring bearings of the type with which the present invention is concerned comprise a pair of semi-circular bearing halves adapted to be operatively assembled to form a complete ring bearing. In such bearings, the inner concave surfaces of the bearing halves are highly finished to form a smooth anti-friction bearing surface. In packaging the bearing halves, care must be taken to prevent contact of the inner concave bearing surface of each bearing half with portions of the other bearing half. Such contact would lead to scratching or otherwise damaging the bearing surfaces.

One technique which has been used in the past to package bearing halves has been to place two bearing halves in a box in back-to-back relationship so that the anti-friction surfaces will not be contacted. Such packaging has the disadvantage of resulting in a relatively large bearing package. Another technique is exemplified in U.S. Pat. No. 3,138,247 issued to G. R. Perry on June 23, 1964. In the arrangement illustrated in this patent, the bearing halves are nested together, the box having a pair of elongated tongues which extend into the interior thereof and act as dividers between the nested bearing halves to prevent contact of one half with the other. This arrangement avoids damage to the bearing surfaces. Somewhat similar packaging techniques are illustrated in U.S. Pat. Nos. 3,307,685, White; 3,342,321, Haffey; and 3,337,037, Thill et al.

In accordance with the present invention, a tray is provided permitting packaging of a relatively large number of bearing halves thus resulting in an economical package. The bearing halves are separated from each other in a manner somewhat similar to that disclosed in the above-mentioned patents in that a rib structure having a herringbone configuration is provided in a series of compartments which receive the bearing halves. However, other than the use of this technique, the package is substantially different than the prior art packaging structures and permits packaging of a relatively large number of bearings, for example, forty bearing halves, in one tray and provides a nesting and stacking arrangement which utilizes the structure of the bearing halves for vertical support thus permitting use of relatively thin walled plastic material to fabricate the trays. This results in a low cost construction which is at the same time durable and practical for the intended use.

SUMMARY OF THE INVENTION

A storage pack compressing at least two stacked and nested trays each loaded with a plurality of semi-circular split ring bearing halves is provided. Each tray includes a plurality of elongated compartments each comprising a bottom wall from which extends a pair of upstanding oppositely disposed end walls and a pair of upstanding oppositely disposed side walls.

The compartments are arranged in a row in side-by-side relationship. The upper edges of the side walls of each pair of adjacent compartments are connected. Each compartment has a row spaced apart upstanding ribs on the bottom wall thereof adjacent each side wall. Each rib in each row is oppositely disposed with respect to a rib in the other row. Each rib extends inwardly of the compartment from the adjacent side wall and is angled towards one end wall of the compartment to define a herringbone structure. The ribs are of substantially less height than the side and end walls of each compartment and of less height than the width of the bearing halves loaded in the tray. The side and end walls of each compartment are of greater height than the width of the bearing halves loaded in the tray.

Bearing halves are loaded in the tray compartments with one side edge thereof resting on a bottom wall with the concave surface of the bearing half facing the other of said end walls of the compartment.

The side and end walls of each tray compartment are angled inwardly of the compartment to facilitate stacking of one tray on top of another with superadjacent compartments nesting within subjacent compartments. The trays are so stacked and nested with the bottom walls of superadjacent compartments resting on and supported by the bearing halves loaded in the subjacent tray compartments.

The upper edges of the side walls of each pair of adjacent tray compartments are preferably connected by a web thereby spacing the compartments apart to facilitate the aforesaid nesting. The trays are preferably fabricated of thin sheet resinous material with the bearing halves provided structural support for the stacked trays.

DETAILED DESCRIPTION OF A PREFERRED EMBODIMENT

Figure 1:
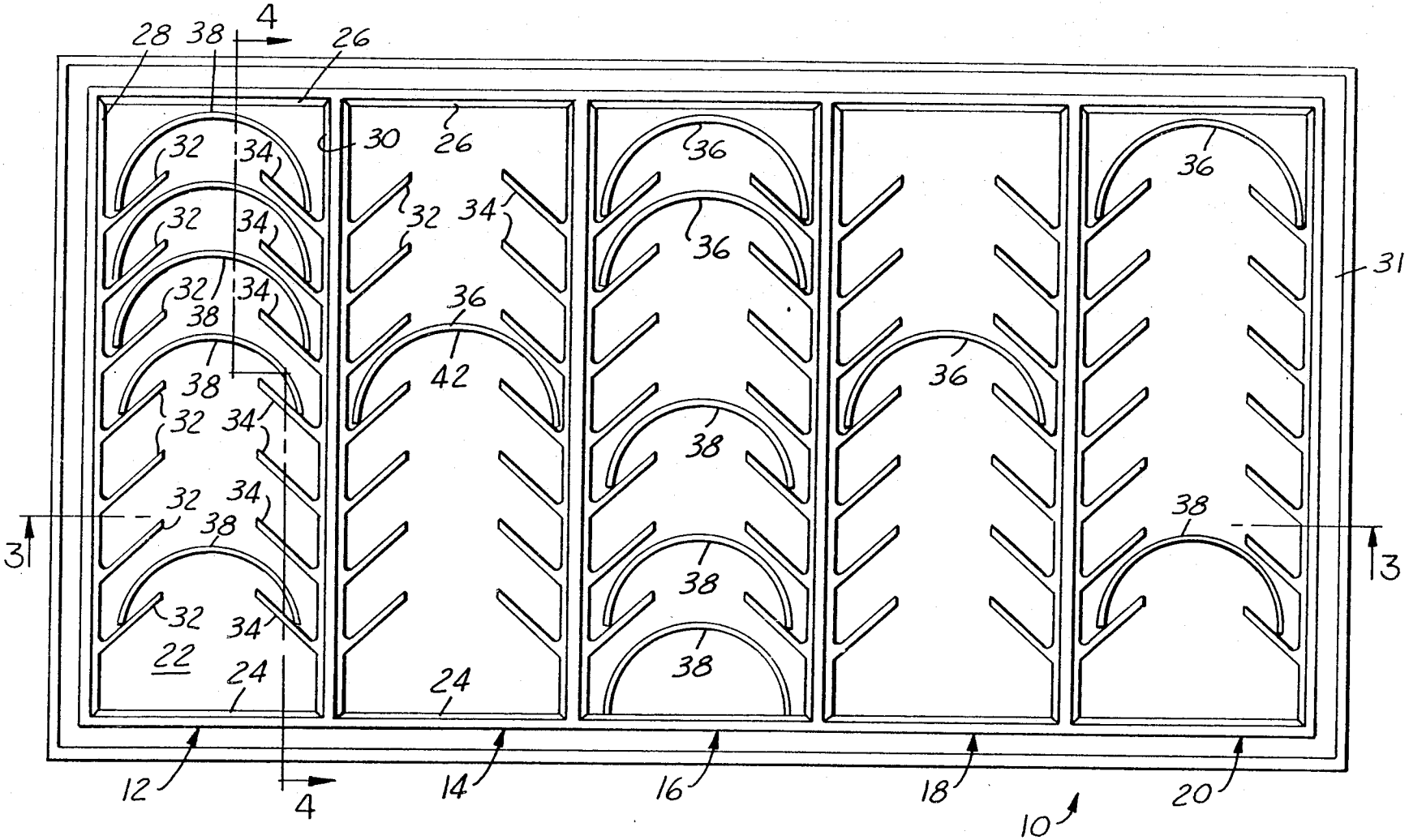
FIG. 1 is a top plan view of a tray for packaging semi-circular split ring bearing halves in accordance with one embodiment of the present invention.
Figure 2:
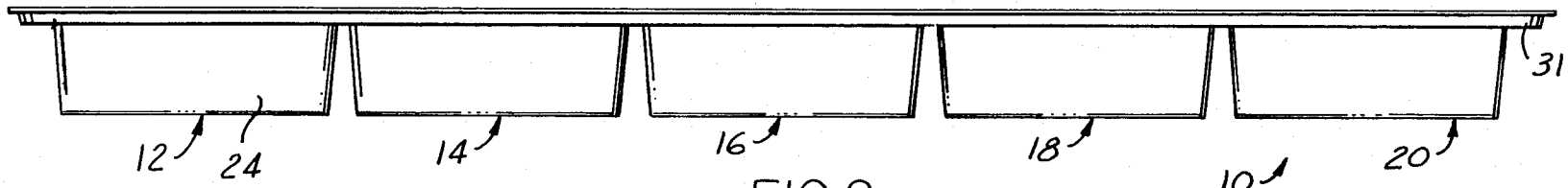
FIG. 2 is a side elevational view of the tray of FIG. 1.

Referring to FIGS. 1 and 2, it will be noted that the tray 10 for packaging semi-circular split ring bearing halves includes a plurality of elongated compartments 12, 14, 16, 18, 20 each of which comprises a bottom wall 22 from which extends a pair of upstanding oppositely disposed end walls 24, 26 and pair of upstanding oppositely disposed side walls 28, 30. The compartments are arranged in a longitudinal row in side-by-side relationship. A lip 31 is provided around the entire upper peripheral edge of the tray 10 for ease of handling. The trays are fabricated of thin sheet resinous material such as polyethylene. This material is particularly desirable as it is oil resistant and flexible. The use of a resinous material is preferred over use of cardboard as has been used in the past. Cardboard requires cleaning before use to avoid what is termed "corrugated dust contamination" which could affect the required shaft to bearing clearance when installed into an engine.

The upper edges of the side walls of each pair of adjacent compartments are connected, preferably by a web 32 as illustrated, so that the compartments will be spaced apart to facilitate nesting and stacking of the trays on top of each other. The end and side walls 24, 26, 28, 30 are angled inwardly of each compartment, as will be noted in the figures.

Figure 3:
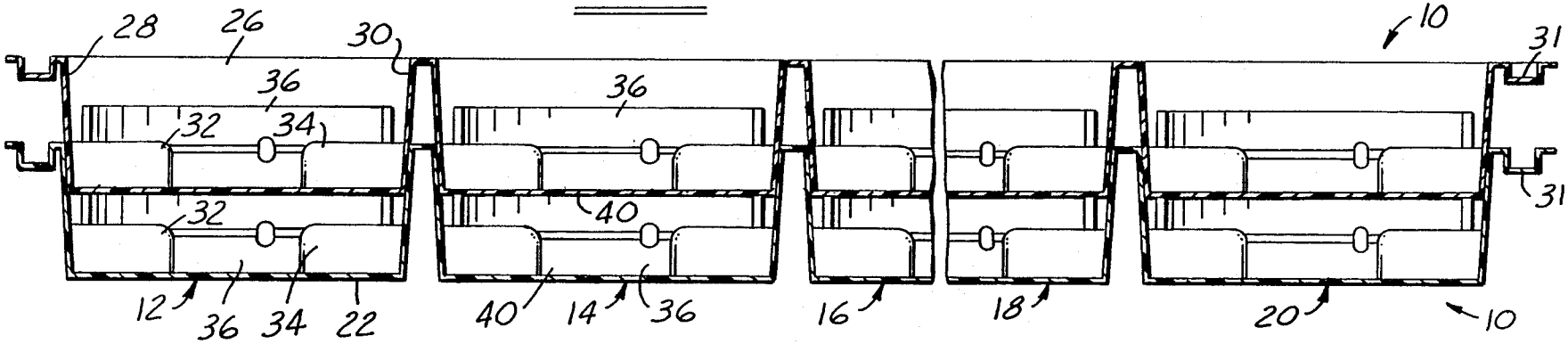
FIG. 3 is a longitudinal sectional view of two loaded trays illustrating the nesting and stacking feature of the trays taken substantially along a line represented by the line 3—3 of FIG. 1 looking in the direction of the arrows.
Figure 4:
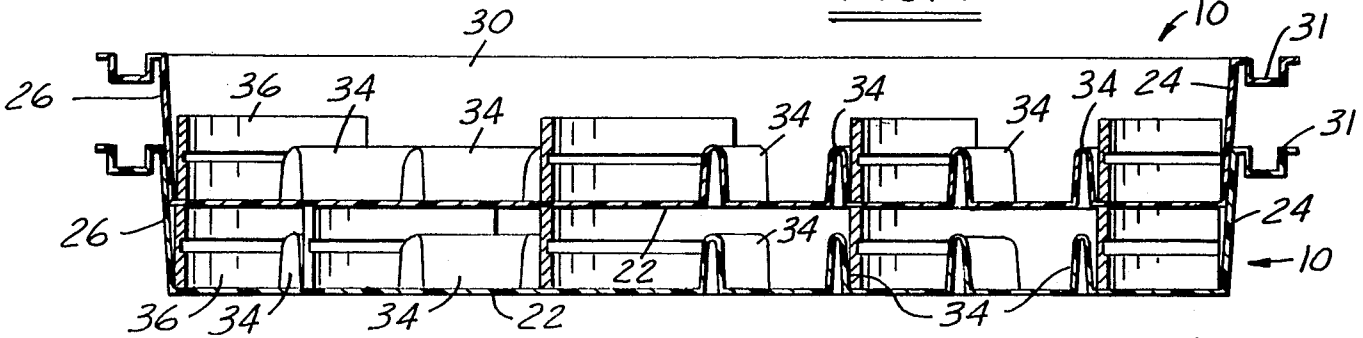
FIG. 4 is a transverse sectional view similar to FIG. 3 taken substantially along a line represented by the line 4—4 of FIG. 1 looking in the direction of the arrows.

This permits nesting of superadjacent compartments within subjacent compartments when the trays are stacked as shown in FIGS. 3 and 4.

Each compartment has a row of spaced apart upstanding ribs 32, 34 on the bottom wall thereof adjacent each side wall 28, 30. Each rib 32, 34 in each row is oppositely disposed with respect to a rib 32, 34 in the other row of the compartment. Each rib extends inwardly of the compartment from the adjacent side wall and is angled towards one end wall 26 as will be noted in FIG. 1 to define a herringbone structure. All the ribs are shown as being angled towards the same end of the compartments, however, they could be angled in the opposite direction or alternately angled in one compartment toward one end and in an adjacent compartment towards the other end. The ribs 32, 34, are spaced far enough apart and the compartments are of adequate width so that bearing halves of different diameter may be received in the tray 10. As will be noted in FIG. 1, bearing halves 36 are of larger diameter than the bearing halves 38. The bearing halves are receivable in the tray 10 compartments with one side edge 40 thereof resting on the bottom wall 22 as will be noted in FIGS. 3 and 4. The concave surfaces 42 of the bearing halves face the other end wall 24 of the compartment with respect to the end wall 26 towards which the ribs 32, 34 are angled. A pair of oppositely disposed ribs 32, 34 are present between each pair of adjacent bearing halves as will be noted in FIG. 1. There is sufficient space present at each end of each row of ribs 32, 34 to permit the reception of a bearing half between the ends of each row of ribs and the adjacent end wall 24, 26 as shown in FIG. 1.

Referring to FIGS. 3 and 4, it will be noted that the ribs 32, 34 are of substantially less height than the end and side walls 24, 26, 28, 30 of each compartment and are of less height than the width of the bearing halves 36 received in the tray 10. Thus, the ribs 32, 34 do not receive any weight when one loaded tray 10 is stacked and nested upon another tray. Vertical loading is assumed by the bearing halves present in each tray upon which another tray is stacked. It is preferred to rotate the upper tray 180° from the tray below it to criss-cross the bearing configuration of each tray and thereby stabilize vertical loading. Thus, the trays 10 may be fabricated of thin walled resinous material as previously mentioned. The end and side walls 24, 26, 28, 30 of each compartment are of greater height than the width of the bearing halves loaded in the trays so that the lower portion of each superadjacent compartment is receivable within the subjacent compartment. This provides the desired nesting which results in lateral stability of a storage pack of a plurality of stacked and nested trays such as the two shown in FIGS. 3 and 4. Additional trays may be loaded onto this storage pack as desired.

I claim:

1. A storage pack comprising at least two stacked and nested trays each loaded with a plurality of semi-circular split ring bearing halves, each tray including a plurality of elongated compartments each comprising a bottom wall from which extends a pair of upstanding oppositely disposed end walls and a pair of upstanding oppositely disposed side walls, the compartments being arranged in a row in side-by-side relationship, the upper edges of the side walls of each pair of adjacent compartments being connected, each compartment having a row of spaced apart upstanding ribs on the bottom wall thereof adjacent each side wall, each rib in each row being oppositely disposed with respect to a rib in the other row, each rib extending inwardly of the compartment from the adjacent side wall and angled towards one end wall of the compartment to define a herringbone structure, the ribs being of substantially less height than the side and end walls of each compartment and of less height than the width of the bearing halves loaded in the tray, the side and end walls of each compartment being of greater height than the width of the bearing halves loaded in the tray, the bearing halves being loaded in the tray compartments with one side edge thereof resting on a bottom wall with the concave surface thereof facing the other of said end walls of the compartment and with a pair of oppositely disposed ribs being present between each pair of adjacent bearing halves, the side and end walls of each tray compartment being angled inwardly of the compartment to facilitate stacking of one tray on top of another with superadjacent compartments nesting within subjacent compartments, the trays being so stacked and nested with the bottom walls of superadjacent compartments resting on and supported by the bearing halves loaded in the subjacent tray compartments.

2. A storage pack as defined in claim 1, further characterized in that the upper edges of the side walls of each pair of adjacent tray compartments are connected by a web thereby spacing the compartments apart to facilitate the aforesaid nesting.

3. A storage pack as defined in claim 1, further characterized in that the trays are fabricated of thin sheet resinous material, the bearing halves providing vertical structural support for the pack.

* * * * *